United States Patent [19]

Goldstein et al.

[11] 4,265,943

[45] May 5, 1981

[54] METHOD AND COMPOSITION FOR CONTINUOUS ELECTROLESS COPPER DEPOSITION USING A HYPOPHOSPHITE REDUCING AGENT IN THE PRESENCE OF COBALT OR NICKEL IONS

[75] Inventors: Rachel Goldstein, Givataim, Israel; Peter E. Kukanskis, Watertown; John J. Grunwald, New Haven, both of Conn.

[73] Assignee: MacDermid Incorporated, Waterbury, Conn.

[21] Appl. No.: 964,128

[22] Filed: Nov. 27, 1978

[51] Int. Cl.[3] ..... C23C 3/02

[52] U.S. Cl. ..... 427/305; 106/1.23; 106/1.26; 106/1.27; 427/437; 427/443.1

[58] Field of Search ..... 427/305, 430 A, 437, 427/443.1; 106/1.23, 1.26, 1.27

[56] References Cited

U.S. PATENT DOCUMENTS

| | | | |
|---|---|---|---|
| 3,046,159 | 7/1962 | Brookshire | 427/437 |
| 3,093,509 | 6/1963 | Wein | 427/305 |
| 3,615,732 | 10/1971 | Shipley et al. | 106/1.23 |
| 3,615,733 | 10/1971 | Shipley et al. | 106/1.23 |
| 3,615,735 | 10/1971 | Shipley et al. | 106/1.23 |
| 3,716,462 | 2/1973 | Jensen | 106/1.23 |
| 3,935,013 | 1/1976 | Lelental | 427/437 |
| 4,019,910 | 4/1977 | Mallory | 427/437 |
| 4,131,699 | 12/1978 | Feldstein | 427/306 |
| 4,138,267 | 2/1979 | Arisato et al. | 427/437 |

FOREIGN PATENT DOCUMENTS

| | | | |
|---|---|---|---|
| 50-30744 | 3/1975 | Japan | 427/437 |
| 51-25432 | 3/1976 | Japan | 427/305 |
| 285439 | 1/1974 | U.S.S.R. | 427/437 |

*Primary Examiner*—John D. Smith

[57] ABSTRACT

Electroless copper deposition solutions, and method of continuously electrolessly depositing copper onto a workpiece using these solutions, are disclosed. The solutions contain, in addition to water as the usual solvent, a soluble source of copper ions, a complexing agent or mixture of agents to maintain the copper in solution, a non-formaldehyde copper reducing agent, such as hypophosphite, effective to reduce the copper ions to metallic copper as a deposit or plating on a prepared surface of a workpiece brought into contact with the solution, and a soluble source of non-copper metallic ions, such as nickel or cobalt ions, which act as an autocatalysis promoter to enable continuous plating using the solutions. The solutions are maintained in an alkaline condition and preferably in a pH range of 11–14 through the addition of pH adjusters. The properties of plating baths using the solutions, such as bath stability as well as plating process parameters such as plating rate, and the quality of deposit may be advantageously controlled through the appropriate selection of the non-copper metallic ion added and the complexing agent used. Optional additives, such as polymers, wetting agents, and various soluble unsaturated organic compounds, may also be utilized to influence these variables.

18 Claims, No Drawings

METHOD AND COMPOSITION FOR CONTINUOUS ELECTROLESS COPPER DEPOSITION USING A HYPOPHOSPHITE REDUCING AGENT IN THE PRESENCE OF COBALT OR NICKEL IONS

BACKGROUND OF THE INVENTION

1. Field of the Invention

This invention relates to the electroless deposition of copper and provides a specific improvement over the invention disclosed in copending application Ser. No. 909,209, now U.S. Pat. No. 4,209,331, filed May 25, 1978 and assigned to the assignee of the present application. In particular, this invention relates to the electroless deposition of copper utilizing a non-formaldehyde type reducing agent to reduce copper ions dissolved in solution, in the presence of nickel or cobalt ions, to metallic copper to provide metal deposits or films of a desired thickness, greater than the limiting thickness obtainable before, on a suitably prepared substrate contacted by the solution as a continuous plating step. By "continuous plating" as used herein is meant a plating operation wherein the plating thickness increases with time at a substantially constant rate similar to the initial plating rate.

In the above-mentioned copending application Ser. No. 909,209, now U.S. Pat. No. 4,209,331, there is disclosed the invention that non-formaldehyde type reducing agents can be usefully employed in commercial installations as a reducer for copper ions in electroless plating baths by observing certain limitations to produce an electrically conductive metallic base or film on suitably prepared substrates, and particularly on catalyzed non-conductive substrates. One such reducing agent disclosed as being especially useful is hypophosphite. The present invention provides any desirable thickness of continuously plated metallic copper in such non-formaldehyde type reducing agent systems through the inclusion of nickel or cobalt ions as autocatalytic agents in the plating bath solutions.

2. Description of the Prior Art

The description of the prior art contained in copending application Ser. No. 909,209, now U.S. Pat. No. 4,209,331, referred to above, and which is incorporated by reference herein, reveals that conventional electroless plating as commercially practiced in the deposition of copper onto various substrates, especially non-conductive substrates, almost without exception uses highly alkaline formaldehyde solutions of divalent copper complexed with various well known agents such as Rochelle salt, amines and others. Given the teaching and experience of the prior art discussed therein, it was surprising and unexpected that a non-formaldehyde type reducing agent, such as hypophosphite, would successfully reduce copper ions to metallic copper for electroless deposition while also providing advantages not available in the typical formaldehyde systems.

While the technical literature clearly establishes that hypophosphite agents are effective and universally used as reducing agents in electroless nickel deposition techniques, there is no suggestion in the prior art that the hypophosphite of nickel baths can be substituted for formaldehyde in copper baths. Thus, in the prior patents, where both electroless nickel as well as copper baths are disclosed, the bath composition examples invariably employ formaldehyde type reducing agents for the copper formulations and, in contrast, hypophosphites for the nickel formulations.

A recent U.S. Patent, No. 4,036,651, teaches incorporation of sodium hypophosphite as a "plating rate adjuster" in an alkaline formaldehyde type electroless copper solution. The patent states expressly "Although sodium hypophosphite is, itself, a reducing agent in electroless nickel, cobalt, palladium and silver plating baths, it is not a satisfactory reducing agent (i.e., will not reduce $Cu^{++}$—$CU^{\circ}$) when used alone in alkaline electroless copper plating baths." In discussing the disclosed baths, the patent states that the sodium hypophosphite is not used up in the plating reaction but instead appears to act as a catalyst for the formaldehyde reduction.

U.S. Pat. No. 3,716,462 states the production of a copper coating on a zinc or zinc alloy body may be obtained using an electroless plating solution consisting essentially of a soluble copper salt, e.g. copper sulfate, a complexing agent, e.g., citric acid, and a reducing agent, e.g. sodium hypophosphite. However, the patent states "heretofore it has been considered difficult and impractical to apply an electroless copper plating to zinc or its alloys", a view which is contrary to accepted common knowledge of plating base metal such as zinc or steel through immersion in a copper-containing solution. Moreover, the patent is limited to plating on zinc whereas "electroless deposition" is generally considered to refer to adhering a metal coating on a non-conductive substrate. Furthermore, it appears that the hypophosphite present in the solutions of the patent has no true utility in the plating process described.

SUMMARY OF THE INVENTION

The present invention not only overcomes the drawbacks associated with alkaline formaldehyde type reducing agent solutions for electroless copper depositions but provides, in addition, the advantage of obtaining varying thicknesses of deposit greater than obtainable before with non-formaldehyde reduced copper plating solutions. That is, the invention provides continuous plating, i.e., at a substantially constant rate similar to the initial plating rate, of metallic copper when utilizing a non-formaldehyde type reducing agent electroless copper plating bath. This is achieved, according to this invention, through the provision of an electroless copper plating bath containing metal ions other than copper, in particular, nickel or cobalt ions, in addition to the non-formaldehyde type reducing agent.

Thus, the present invention provides the principal advantages of the novel non-formaldehyde reduced electroless copper bath systems disclosed in copending application Ser. No. 909,209, now U.S. Pat. No. 4,209,331 and the further surprising and unexpected primary advantage that the plating or deposition maintains a more linear deposition rate for longer immersion time, rather than producing depositions of limited thickness. The nickel or cobalt ions may be characterized as providing a synergistic effect in the non-formaldehyde reduced system to produce continuous plating. Consequently, the electroless copper bath composition and plating process of this invention make it possible to obtain depositions of greater thickness using non-formaldehyde reduced copper plating systems and provide for greater variety of usage in commercial applications.

It has been discovered that different advantages can be obtained utilizing different constituents in the electroless copper plating bath. Thus, the electroless copper plating baths embodying the compositions of this invention may advantageously include, in addition to conventional constituents providing a source of cupric ions and a solvent for these, the non-formaldehyde type reducing agent, advantageously hypophosphite, a source of cobalt or nickel ions and choice of complexing agents or mixtures thereof selected for their advantageous compatability with either the nickel or cobalt ions. Moreover, additives may be optionally employed for added benefits.

The complexing agents or mixtures of agents which may be advantageously employed in this invention include those which will enable nickel or cobalt to co-deposit with the copper. It is theorized, although we do not wish to be bound thereby, that agents will meet this criterion when the stability constants of nickel or cobalt, in solutions including these agents, are substantially the same as the stability constant of the copper in order to obtain the same kinetic drive. Again without intending to be bound by any theory of the action taking place, what we mean is that the reduction potential for both the autocatalysis-promoting metal and the copper in solution be substantially equal so as to cause co-deposition.

While various complexing agents or mixtures of agents can be expected to fulfill the above desired characteristics, specific examples of such include the various hydroxy acids and their metal salts such as the tartrates, gluconates, glycerates, lactates and the like. In addition, others will work successfully under controlled conditions. These include amine type agents such as N-hydroxyethyl ethylenediamine triacetic acid (HEEDTA), ethylenediamine tetraacetic acid (EDTA), and nitrilotriacetic acid (NTA), and alkali metal salts of these. The metal bath system may optionally include unsaturated organic compound additives such as butyne diol or butene diol, sodium alkyl sulfonate and polymers such as "Polyox", a polyoxyethylene oxide available from Union Carbide Company, and "Pluronic 77", a block copolymer of polyoxyethylene and polyoxypropylene available from BASF Wyandotte Chemical Company.

The electroless copper bath containing cobalt or nickel ions is maintained in an alkaline condition. The pH should be maintained at a level which will provide optimum results, generally at least 7 or above and preferably in the range of 11–14 since at lower pH levels the system tends to become noncontinuous, that is, it will plate only to a limited thickness which is often too restrictive. As will be explained in greater detail below, plating bath properties and process parameters, such as bath stability and rate and purity of deposit may be advantageously determined through the appropriate selection of the constituents described above and control of their amounts relative to one another.

Accordingly, a feature of this invention is the provision of a formaldehyde-free electroless copper plating bath containing nickel or cobalt ions.

Another feature of this invention is the provision of a process for continuous plating of copper using formaldehyde-free electroless copper plating bath.

A further feature of this invention is the provision of an electroless copper plating bath composition and a method of plating by which continuous plating of essentially metallic copper is achieved in a formaldehyde-free copper bath system by incorporating in the system metallic ions other than copper which ions, or deposits which result from the presence of such ions, act as catalysts for continuing the copper deposition.

The foregoing and other features, advantages and objects of this invention will become further apparent from the following description of preferred embodiments thereof.

DESCRIPTION OF THE PREFERRED EMBODIMENTS

The plating solutions embodying the composition of this invention include, in addition to the usual major categories of constituents of conventional electroless copper baths such as a solvent, usually water, and a source of cupric ions, a complexing agent, the non-formaldehyde type reducing agent, in this case a soluble source of hypophosphite, and a source of nickel or cobalt ions and, where required, a pH adjuster.

The sources of copper, nickel and cobalt in the plating solutions may be comprised of any of the normally used soluble salts of those metals. Chlorides and sulfates are usually preferred because of availability, but other anions, organic or inorganic, may also be used.

Since the proper pH level of the plating bath is important in order to obtain continuous plating, adjustment of pH to maintain an alkaline condition may be needed. If adjustment is required, more standard acids or bases may be employed to return the level to the correct operating range. Since continued liberation of acid plating lowers the pH of the bath with time, some adjustment will be required for extended periods of use, especially to maintain the pH in the preferred 11–14 range. Normally, a caustic such as sodium hydroxide will be added. Buffers may also be employed as aids in maintaining the selected pH range.

Satisfactory continuous deposition according to this invention is obtained by utilizing as a substrate one which has had its surface adequately prepared. That is, a nonconductive substrate desirably has its surface catalyzed by palladium-tin catalysts known in the art.

The mechanism for the continuous reduction of copper ions to copper metal in the presence of cobalt or nickel ions in the disclosed system is not known. However, it can be hypothesized that the noble metal catalyst, such as palladium, on the surface of the substrate initiates the reaction by forming strongly reducing radicals or radical ions from the hypophosphite reducing agent. These strongly reducing species on the surface of the catalyst then act by electron transfer reaction to reduce the copper ions to copper metal. Along with the reduction of copper metal, it is thought that small quantities of the cobalt or nickel ions in solution are also reduced and included in small quantities in the copper deposit, either as nickel or cobalt metal or as some copper-cobalt or copper-nickel alloy. Studies of the deposited metal have shown small quantities of the cobalt or nickel to be present in the copper deposit. As the deposition continues, it is believed that the palladium noble metal catalyst eventually is covered, and that the inclusions of cobalt or nickel metal, or cobalt-copper or nickel-copper alloy, further react with the hypophosphite reducing agent to produce the reducing radicals or radical ions necessary to continue the electroless deposition process.

Sodium hypophosphite is the most readily available form of hypophosphite and is accordingly preferred. Hypophosphorous acid is also available and can be used in conjunction with pH adjusters to prepare a bath of this material. The optimum concentration is that level which will be sufficient to provide an adequate copper film in a reasonable period of time.

The type of complexing agent utilized will effect, to some extent, the rate of plating as well as the continuity of the plating and type of deposit obtained. Thus, when cobalt is the autocatalysis promoter ion in the hypophosphite reduced copper bath, complexers such as tartrates, gluconates and trihydroxy-glutaric acid are advantageous for continuous plating of thin films.

When using the alkyl amine complexing agents such as N-hydroxyethyl ethylenediamine triacetic acid (HEEDTA). ethylenediamine tetraacetic acid (EDTA) or nitrilotriacetic acid (NTA), a nickel or cobalt ion containing copper bath system is continuous if the amount of complexing agent added is insufficient to tie up all of the nickel or cobalt ion. That is, some nickel and cobalt ion must remain free to co-deposit in order to maintain the continuous plating process. Nickel and cobalt will not co-deposit if the complexing agent is too strong; that is, promotes the stabilization of the higher oxidation state. Thus, the balance of such complexing agent in the system must be controlled for continuous plating.

In addition to the foregoing complexing agents, there may also be successfully added unsaturated organic compounds, polymers, and combinations of these. These optional additives, such as butyne or butene diol, sodium alkyl sulfonate and polymers such as "Polyox" and "Pluronic 77", are compatible with the system of the invention and will act there in the same manner as known in current plating systems.

Observations indicate that the rate of deposition of copper from these electroless solutions is essentially linear. For example, plating is still proceeding after 90 minutes, which suggests that the deposition will continue even longer because by such time palladium on the catalyzed surface has certainly been covered by the deposit and no longer functions as the active catalyst for the continuing plating operation. Although this system appears to be passive to pure copper, this can be overcome in various ways by suitably catalyzing the surface to overcome the initial passivity, and electroless plating then occurs.

The following examples illustrate preferred conditions for practicing the invention.

EXAMPLES 1-18

In these examples, a workpiece comprising a plastic substrate in the form initially of a blank laminate consisting of aluminum foil bonded to a fiberglass reinforced epoxy resin substrate, commercially known as "Epoxyglass FR-4 PLADD II Laminate" was prepared using the "PLADD" process of MacDermid Incorporated, Waterbury, Conn., disclosed in U.S. Pat. No. 3,620,933. The workpiece is placed in a hydrochloric acid bath to dissolve the aluminum cladding, leaving the resin surface activated for reception of an electroless plating. Following thorough rinsing, the workpiece is catalyzed. This can be accomplished in the "one-step" method using a mixed palladium-tin catalyst of commercial type. Such catalyst, along with its method of use, is disclosed in U.S. Pat. No. 3,352,518. Following rinsing, the catalyzed workpiece is next placed in a so-called "accelerating solution" to reduce or eliminate the amount of residual tin retained on the surface since tin tends to impede copper deposition. Again, many types of accelerating baths can be employed, for example the one disclosed in the above mentioned U.S. Pat. No. 3,352,518, such accelerating baths generally consisting of an acid solution. Alkaline accelerators such as sodium hydroxide solution have also been used successfully. The workpiece is then ready, after further rinsing, for copper plating.

The catalyzed workpiece is then copper plated, using a semi-additive process, in a copper bath including the following constituents:

$CuCl_2.2H_2O$
$KNaTar.4H_2O$
$NaOH$
$NaH_2PO_2.H_2O$ and either $CoCl_2.6H_2O$ or $NiSO_4.6H_2O$ The results, with certain parameters of composition and time varied, are set forth in TABLE I which shows the thickness of deposit, in microinches, obtained. Concentrations of constituents are in moles/liter. The observed results are as follows.

TABLE I

| EXAMPLE | 1 | 2 | 3 | 4 | 5 | 6 | 7 | 8 | 9 | 10 |
|---|---|---|---|---|---|---|---|---|---|---|
| $CuCl_2 . 2H_2O$, M | .024 | .024 | .024 | .024 | .024 | .024 | .024 | .024 | .024 | .022 |
| $CoCl_2 . 6H_2O$, M | — | — | — | .0005 | .0005 | .0005 | .0004 | .0005 | .001 | — |
| $NiSO_4 . 6H_2O$, M | — | — | — | — | — | — | — | — | — | .002 |
| KNa Tartrate, M | .037 | .037 | .037 | .037 | .037 | .037 | .037 | .037 | .037 | .037 |
| NaOH, M | .156 | .156 | .156 | .156 | .156 | .156 | .156 | .156 | .156 | .156 |
| $NaH_2PO_2 . H_2O$, M | .20 | .20 | .20 | .20 | .20 | .20 | .20 | .20 | .20 | .165 |
| Time, min. | 10 | 30 | 60 | 10 | 30 | 60 | 20 | 20 | 20 | 10 |
| Temp., °C. | 60 | 60 | 60 | 60 | 60 | 60 | 60 | 60 | 60 | 60 |
| Thickness, μdn. | 15 | 15 | 15 | 54 | 160 | 328 | 96 | 100 | 126 | 31 |

| EXAMPLE | 11 | 12 | 13 | 14 | 15 | 16 | 17 | 18 |
|---|---|---|---|---|---|---|---|---|
| $CuCl_2 . 2H_2O$, M | .022 | .022 | .022 | .022 | .022 | .022 | .022 | .022 |
| $CoCl_2 . 6H_2O$, M | — | — | — | — | — | — | — | — |
| $NiSO_4 . 6H_2O$, M | .002 | .002 | .0008 | .002 | .004 | .002 | .002 | .002 |
| KNa Tartrate, M | .037 | .037 | .037 | .037 | .037 | .037 | .037 | .037 |
| NaOH, M | .156 | .156 | .156 | .156 | .156 | .156 | .156 | .156 |
| $NaH_2PO_2 . H_2O$, M | .165 | .165 | .165 | .165 | .165 | .165 | .165 | .165 |
| Time, min. | 30 | 75 | 20 | 20 | 20 | 30 | 30 | 30 |
| Temp., °C. | 60 | 60 | 60 | 60 | 60 | 26 | 42 | 60 |
| Thickness, μdn. | 99 | 264 | 76 | 80 | 67 | 18 | 61 | 99 |

Examples 1, 2 and 3 show a bath formulation containing no nickel or cobalt autocatalysis promoter with immersion times of 10, 30 and 60 minutes. The deposit thickness builds to about 15 microinches and then terminates. It can be seen that longer deposition times will not result in increased deposit thickness. The termination of plating is followed by some type of oxide development on the copper surface.

Examples 4, 5 and 6 duplicate Examples 1, 2 and 3 except that a small amount of cobalt ion is added to the bath formula. The deposits are pink, indicating good conductivity, and adherent to the substrate. No termination of deposit occurs, and the linearity of deposition rate can be seen with increasing immersion time.

Examples 7, 8 and 9 show the effect of varying cobalt ion concentration, indicating that higher cobalt ion levels appear to accelerate plating rate.

Examples 10, 11 and 12 show linearity of deposition rate using nickel ion instead of cobalt ion.

Examples 13, 14 and 15 show results with varying nickel ion levels. The higher nickel ion levels do not appear to dramatically accelerate the plating rate, compared to that observed with the cobalt ion.

Examples 16, 17 and 18 show the effect of varying temperature. In general, higher temperatures give higher deposition rates, as might be expected.

EXAMPLES 19–22

Copper plating was carried out in Examples 19–22 according to the procedure of Examples 1–18, but using gluconic acid, neutralized to sodium gluconate, as the complexing agent in place of the tartrate. The results are set forth in TABLE II.

TABLE II

| EXAMPLE | 19 | 20 | 21 | 22 |
|---|---|---|---|---|
| $CuCl_2 . 2H_2O$, M | .036 | .036 | .0234 | .0234 |
| $CoCl_2 . 6H_2O$, M | .00075 | .00075 | .0006 | .0006 |
| $NiSO_4 . 6H_2O$, M | — | — | — | — |
| KNa Tartrate, M | .052 | .052 | .037 | .037 |
| NaOH, M | .23 | .23 | .156 | .156 |
| $NaH_2PO_2 . H_2O$, M | .30 | .30 | .30 | .30 |
| Pluronic 77, ppm | 250 | 250 | — | — |
| Butyne Diol, ppm | — | — | 100 | 100 |
| P.E.G. | — | — | — | — |
| Time, min. | 20 | 75 | 20 | 60 |
| Temp., °C. | 41 | 41 | 40 | 40 |
| Thickness, μin. | 76 | 250 | 90 | 246 |

Example 19 contains no nickel or cobalt ion autocatalysis promoter and shows the termination of plating at about 15 microinches.

Example 20 shows that the addition of nickel ion promotes the autocatalytic nature of this bath.

Examples 21 and 22 illustrate the effect of adding the organic polymer polyethylene glycol (P.E.G.—20,000 molecular weight). The addition of 100 ppm of the material slows the deposition rate. However, the autocatalytic nature of this system and linearity of deposition rate is maintained. The addition of polyethylene glycol, although slowing the deposition rate appears to give pinker and smoother deposits, and also gives added stability to the solution.

EXAMPLES 23–35

Examples 23–35 show the results obtained using plating procedure of the previous examples, but with varying component concentrations and using unsaturated organic or polymer additives. The results are set forth in TABLE III.

Examples 23 and 24 utilize 250 ppm of "Pluronic 77", a block copolymer polyoxyethylene polyoxypropylene available from BASF Wyandotte Chemical Company. Time is varied to show linearity of deposition rate. "Pluronic 77" appears to give pinker and smoother deposits, and added solution stability.

Examples 25 and 26 use 100 ppm of butyne diol as an organic additive. Here again, deposit linearity is maintained and the butyne diol appears to give pinker and smoother deposits, and added bath stability.

Examples 27, 28, 29 and 30 show the effect of varying concentration from 0 to 500 ppm of organic additive butyne diol. The examples illustrate that the addition of butyne diol slows deposition rate, and that increasing levels of butyne diol give correspondingly lower rates of deposition. Along with the reduction of plating rate caused by the organic additive, a somewhat pinker and smoother deposit is evident, and solution stability is increased.

Examples 31–35 use nickel ions as the autocatalysis promoter and the organic additive polyethylene glycol (P.E.G.). Similar trends are observed by increasing the level of P.E.G., in that it slows deposition rate and appears to give pinker and smoother deposits.

TABLE III

| EXAMPLE | 23 | 24 | 25 | 26 | 27 | 28 | 29 | 30 | 31 | 32 | 33 | 34 | 35 |
|---|---|---|---|---|---|---|---|---|---|---|---|---|---|
| $CuCl_2 . 2H_2O$, M | .036 | .036 | .0234 | .0234 | .024 | .024 | .024 | .024 | .022 | .022 | .022 | .022 | .022 |
| $CoCl_2 . 6H_2O$, M | .00075 | .00075 | .0006 | .0006 | .0005 | .0005 | .0005 | .0005 | — | — | — | — | — |
| $NiSO_4 . 6H_2O$, M | — | — | — | — | — | — | — | — | .002 | .002 | .002 | .002 | .002 |
| KNa Tartrate, M | .052 | .052 | .037 | .037 | .037 | .037 | .037 | .037 | .037 | .037 | .037 | .037 | .037 |
| NaOH, M | .23 | .23 | .156 | .156 | .156 | .156 | .156 | .156 | .156 | .156 | .156 | .156 | .156 |
| $NaH_2PO_2 . H_2O$, M | .30 | .30 | .30 | .30 | .30 | .30 | .30 | .30 | .30 | .30 | .30 | .30 | .30 |
| Pluronic 77, ppm | 250 | 250 | — | — | — | — | — | — | — | — | — | — | — |
| Butyne Diol, ppm | — | — | 100 | 100 | — | 25 | 100 | 500 | — | — | — | — | — |
| P.E.G. | — | — | — | — | — | — | — | — | 230 | 230 | 230 | 100 | 100 |
| Time, min. | 20 | 75 | 20 | 60 | 20 | 20 | 20 | 20 | 10 | 35 | 75 | 20 | 90 |
| Temp., °C. | 41 | 41 | 40 | 40 | 60 | 60 | 60 | 60 | 60 | 60 | 60 | 60 | 60 |
| Thickness, μin. | 76 | 250 | 90 | 246 | 131 | 119 | 100 | 84 | 41 | 144 | 335 | 73 | 328 |

EXAMPLES 36 and 37

Examples 36 and 37 are similar to the previous examples except that here the plating baths utilize the amino acid complexing agent, nitrilotriacetic acid (NTA), along with the hydroxy acid complexing agent, tartaric acid. The results, set forth in TABLE IV, show that the linearity of deposition rate is maintained in this system.

TABLE IV

| EXAMPLE | 36 | 37 |
|---|---|---|
| $CuSO_4 . 5H_2O$, M | .022 | .022 |
| $NiSO_4 . 6H_2O$, M | .002 | .002 |
| KNa Tartrate, M | .033 | .033 |
| NTA, M | .052 | .052 |
| NaOH, M | .156 | .156 |
| $NaH_2PO_2 . H_2O$, M | .165 | .165 |
| Time, min. | 10 | 60 |
| Temp., °C. | 60 | 60 |
| Thickness, μin. | 44 | 271 |

EXAMPLES 38–46

In Examples 38–46, a typical workpiece comprising a standard commercial plating grade ABS panel is first cleaned to remove surface grime, oil, etc. An alkaline cleaning solution as typically used in prior plating systems may be used here also. This is followed by chemical etch using mixed chromic-sulfuric or all chromic acid, also standard in the industry. Typical operating conditions, concentration and time of treatment are disclosed in U.S. Pat. No. 3,515,649. The workpiece then goes through the typical preplate operation such as rinsing, catalyzing and accelerating baths as described in the previous examples. The workpiece is then immersed in various baths for plating. The results are set forth in TABLE V which shows the time, in minutes, at which the deposition of plate terminates. The coating weight, expressed in milligrams per square centimeter is also given.

TABLE V

| EXAMPLE | 38 | 39 | 40 | 41 | 42 | 43 | 44 | 45 | 46 |
|---|---|---|---|---|---|---|---|---|---|
| $Cu^{++}$, M | .024 | .024 | .024 | .024 | .024 | .024 | .024 | .024 | .024 |
| $Co^{++}$, M | — | .00034 | .00076 | .0010 | — | — | — | — | — |
| $Ni^{++}$, M | — | — | — | — | .00034 | .00076 | .0010 | .0013 | .0017 |
| KNa Tartrate, M | .052 | .052 | .052 | .052 | .052 | .052 | .052 | .052 | .052 |
| NaOH, M | .075 | .075 | .075 | .075 | .075 | .075 | .075 | .075 | .075 |
| $NaH_2PO_2 \cdot H_2O$, M | .27 | .27 | .27 | .27 | .27 | .27 | .27 | .27 | .27 |
| Time, min. | — | 6 | 55 | 90 | 4 | 6 | 8 | 15 | 35 |
| Coating Weight, mg/cm$^2$ | 0 | .77 | 5.62 | 7.36 | .37 | .50 | .65 | 1.17 | 3.25 |

Example 38 illustrates a plating bath containing no nickel or cobalt ion autocatalysis promoter. Although the ABS workpiece had been through the typical preplate treatments, it is impossible to obtain a deposit at the conditions set forth in TABLE V.

Examples 39, 40 and 41 are examples showing the effect of cobalt ions in the bath. The examples in TABLE V illustrate the effect of increasing concentrations of the autocatalysis promoter metal, such as cobalt or nickel ions, in a fixed bath formulation. The approximate time at which the deposition of plate stops is evident by observing stoppage of gassing (hydrogen gas evolution). Also, a tarnishing (assumed to be some type of oxide formation) occurs on the deposited metal. This phenomenon is referred to here as "termination".

Since no replenishment of bath components was made during these tests, it is speculated that as soon as the autocatalysis promoter metal is effectively depleted from solution, the electroless plating terminates. This appears from Examples 39–41 showing that increasing cobalt ion concentration allows the electroless plating process to continue for longer times and allows for greater thickness build up. Examples 42–46 show the similar effect for nickel ion. It should be noted that if both replenishments were made so as to maintain the workable levels of the essential constituents, the electroless deposition process would continue without termination.

EXAMPLES 47–52

Examples 47–52 are directed to plating on the ABS workpiece as described in Examples 38–46. The results when immersion time and temperature of the plating bath are varied are set forth in TABLE VI.

TABLE VI

| EXAMPLE | 47 | 48 | 49 | 50 | 51 | 52 |
|---|---|---|---|---|---|---|
| $Cu^{++}$, M | .024 | .024 | .024 | .024 | .024 | .024 |
| $Co^{++}$, M | .001 | .001 | .001 | .001 | .001 | .001 |
| KNa Tartrate, M | .052 | .052 | .052 | .052 | .052 | .052 |
| NaOH, M | .12 | .12 | .12 | .12 | .12 | .12 |
| $NaH_2PO_2 \cdot H_2O$, M | .27 | .27 | .27 | .27 | .27 | .27 |
| Time, min. | 10 | 30 | 60 | 10 | 10 | 10 |
| Temp. °C. | 45 | 45 | 45 | 25 | 40 | 60 |
| Thickness, μin. | 51 | 140 | 240 | 25 | 40 | 75 |

Examples 47, 48 and 49 show the linearity of deposit. As immersion time increases, deposition thickness increases at an effectively proportional or linear rate.

Examples 50, 51 and 52 show that, for a given immersion time, increases in temperature show increasing thickness of deposit.

In all these examples, the deposits are smooth, pink and well adhered to the substrate and are readily acceptable for subsequent electroplating. Typical adhesion values of the metal to substrate are about 8 lb./inch.

EXAMPLES 53–57

Examples 53–57 illustrate that the concentration levels of the basic constituents may be successfully varied. The results, set forth in TABLE VII, show that rather than having narrowly set operable limits of components, the plating baths of the invention are operable with minimum amount of the basic constituents to effect the reaction.

While higher amounts of materials can naturally be tolerated, determination of maximum amounts are best made by observation of the various synergistic effects the basic components have on one another. A general guideline would be to avoid concentrations of the various components which would exceed solubility parameters. Also, operation at near maximum solubility levels would leave no room for maintenance additions, nor leave room to solubilize reduction products in the course of normal operation. Naturally, from an economic standpoint, it would not be commercially practical to maintain functionally unnecessary concentrations since drag out of solution with the work would introduce added costs. Those skilled in the art will be able to ascertain the appropriate levels based on simple observations of the results obtained and can vary the levels to suit particular purposes.

TABLE VII

| EXAMPLE | 53 | 54 | 55 | 56 | 57 |
|---|---|---|---|---|---|
| $Cu^{++}$, M | .008 | .008 | .008 | .008 | .008 |
| $Co^{++}$, M | .00017 | .00017 | .00017 | — | — |
| $Ni^{++}$, M | — | — | — | .00017 | .00017 |
| KNa Tartrate, M | .025 | .025 | .025 | .025 | .025 |
| NaOH, M | .05 | .05 | .05 | .05 | .05 |
| $NaH_2PO_2 \cdot H_2O$, M | .07 | .07 | .07 | .07 | .07 |
| Time, min. | 20 | 10 | 5 | 10 | 10 |
| Temp, °C. | 40 | 50 | 60 | 50 | 60 |

TABLE VII-continued

| EXAMPLE | 53 | 54 | 55 | 56 | 57 |
|---|---|---|---|---|---|
| Coating Weight, mg/cm$^2$ | .30 | .41 | .73 | .50 | .56 |

The successful electroless plating of the "Epoxyglass FR-4 PLADD II Laminate" described demonstrates the suitability of the present invention to the semi-additive plating process used to prepare printed circuit boards. After a thin copper deposit has been electrolessly deposited across the entire surface of the substrate, a mask or resist is then applied, as by screening, photopolymeric development, etc., to define a desired printed circuit. The masked (thin-plated) substrate is then further plated in an electrolytic bath, using the initial electroless deposit as a "bus" to build up additional metal thickness in the unmasked regions of the circuit board. The resist or mask is next chemically dissolved and the board is placed in a suitable copper etchant solution, such as that disclosed in U.S. Pat. No. 3,466,208, for a time sufficient to remove the thin initial copper deposit previously covered by the resist, but insufficient to remove the substantially thicker regions of copper (or other metal) deposit built up in the electrolytic plating bath. This technique is sometimes referred to in the art as a semi-additive plating process.

In a similar manner, the invention is applicable to the "subtractive" procedure for preparation of printed circuit boards having through-holes for interconnecting conductor areas on opposite surfaces of standard copper foil clad laminates. The through-holes are punched or drilled in the blank board, and the walls of the through-holes plated with copper electrolessly, using the copper solution of this invention. A resist is then provided to give the desired circuit traces, and additional thickness of the wall deposit as well as circuit traces can be provided by electrolytic deposition, if desired. Depending on further plating requirements, such as gold plating of connector tab areas on the circuit, solder coating, etc., the circuit board is next placed in an etching bath to remove non-circuit areas of the initial foil.

Although specific embodiments of the present invention have been described above in detail, it is to be understood that these are primarily for purposes of illustration. Modifications may be made to the particular conditions and components disclosed consistent with the teaching herein, as will be apparent to those skilled in the art, for adaptation to particular requirements.

What is claimed is:

1. In a composition for the electroless deposition of copper including, in an essentially alkaline aqueous solution, a soluble source of cupric ions, a complexing agent to maintain the cupric ions in solution and a reducing agent capable of providing a soluble source of hypophosphite ions effective to reduce the cupric ions to metallic copper to obtain satisfactory copper deposition on the prepared surface of a workpiece when in contact with the solution, the improvement therein providing continuous deposition of the copper on the workpiece such that the deposition thickness increases with time at a substantially constant rate similar to an initial deposition rate comprising including in the solution a soluble source of metal ions other than cupric ions which ions are capable of functioning as an autocatalysis promoter for metallic copper deposition, the metal ions in solution being predominantly cupric ions and the solution pH being maintained in the range of 11–14.

2. The improved composition as claimed in claim 1, wherein the source of metal ions other than cupric ions is one which provides ions selected from the group consisting of nickel and cobalt ions and combinations of the same.

3. The improved composition as claimed in claim 1, wherein the complexing agent is one which, in the solution, enables the metal ions other than cupric ions to codeposit with the cupric ions in small quantities forming an essentially copper deposit.

4. The improved composition as claimed in claim 3, wherein the complexing agent is one which, in the solution, provides the metal ions other than cupric ions with a stability constant substantially equal to the stability constant of the cupric ions, to obtain substantially the same kinetic drive for all the metal ions in solution.

5. An electroless copper deposition solution for the continuous plating of copper at a substantially linear plating rate comprising, in addition to water, a soluble source of cupric ions, a complexing agent to maintain the cupric ions in solution and a soluble source of hypophosphite ions effective to reduce the cupric ions to essentially metallic copper as a deposit on a catalyzed non-conductive surface of a workpiece when in contact with the solution, and a soluble source of non-cupric metal ions selected from the group consisting of nickel and cobalt and combinations of the same, pH adjusters as required in an amount effective to maintain the solution pH in a range of 11–14; the complexing agent being one which enables the non-cupric metal ions to codeposit with the copper in small quantities and to act as an autocatalysis promoter.

6. An electroless copper deposition solution as claimed in claim 5, wherein the complexing agent is one selected from the group consisting of soluble hydroxy acids and hydroxy acid metal salts.

7. An electroless copper deposition solution as claimed in claim 5, wherein the complexing agent is one selected from the group consisting of soluble tartrates, gluconates, glycerates, glycolates, lactates and mixtures thereof.

8. An electroless copper deposition solution as claimed in claim 7, wherein the complexing agent further comprises an amino acid complexing agent selected from the group consisting of N-hydroxyethyl ethylenediamine triacetic acid (HEEDTA), ethylenediamine tetraacetic acid (EDTA) and nitrilotriacetic acid (NTA) and alkali metal salts of the same.

9. An electroless copper deposition solution as claimed in claim 5, wherein the complexing agent is one selected from the group consisting of N-hydroxyethyl ethylenediamine triacetic acid (HEEDTA), ethylenediamine tetraacetic acid (EDTA) and nitrilotriacetic acid (NTA), and is present in an amount insufficient to react all of the non-cupric ions to form a complex therewith so that at least some non-cupric ions remain available for co-deposition with the copper.

10. An electroless copper deposition solution as claimed in claim 5, further comprising an additive compound selected from the group consisting of unsaturated organic compounds and polymers.

11. An electroless copper deposition solution as claimed in claim 5, further comprising an additive compound selected from the group consisting of butyne diol, butene diol, polyoxyethylene, polyethylene glycol and a block copolymer of polyoxyethylene and polyoxypropylene.

12. The improved composition as claimed in claims 1 or 5 wherein the ratio of cupric ions to the other metal ions in solution is at least 5.5:1.

13. A method of continuously electrolessly depositing a copper plating on the surface of a workpiece comprising the steps of preparing the surface of the workpiece to render it more receptive to the plating, immersing the workpiece in a solution comprising, in addition to water, a soluble source of cupric ions, a complexing agent to maintain the cupric ions in solution, and a a soluble source of hypophosphite ions effective to reduce the cupric ions to metallic copper as a deposit on the surface of the workpiece when in contact with the solution, and a soluble source of non-cupric metal ions which are capable of functioning as an autocatalysis promoter for the copper plating, and maintaining the pH of the solution at an operable level which enables the satisfactory continuous deposition of a copper plating on the workpiece, and depositing the copper plating on the workpiece at a thickness which increases with time of immersion with a substantially constant rate of deposition essentially the same as the initial rate of deposition.

14. A method of continuously electrolessly depositing a copper plating as claimed in claim 13, wherein the soluble source of non-cupric ions comprises a source of nickel and/or cobalt ions.

15. A method of continuously electrolessly depositing a copper plating as claimed in claim 13, and further comprising the step of increasing the temperature of the plating solution to increase the deposition rate.

16. A method of continuously electrolessly depositing a copper plating as claimed in claim 13, wherein the complexing agent is one which, in the solution, enables the metal ions other than cupric ions to co-deposit with the cupric ions in small quantities and form a co-deposit with the metallic copper.

17. A method of continuously electrolessly depositing a copper plating as claimed in claim 13, wherein the complexing agent is one selected from the group consisting of soluble tartartes, gluconates, glycerates, glycolates, lactates and mixtures thereof.

18. A method of continuously electrolessly depositing a copper plating as claimed in claim 13, wherein the complexing agent further comprises an additive compound selected from the group consisting of butyne diol, butene diol, polyoxyethylene, polyethylene glycol and a block copolymer of polyoxyethylene and polyoxypropylene.

* * * * *